US007041171B2

(12) United States Patent
DeMent et al.

(10) Patent No.: US 7,041,171 B2
(45) **Date of Patent: *May 9, 2006**

(54) NOZZLE FOR USE IN ROTATIONAL CASTING APPARATUS

(75) Inventors: R. Bruce DeMent, Lemont, IL (US); Paul Werstler, Evergreen Park, IL (US)

(73) Assignee: Kastalon, Inc., Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/659,732

(22) Filed: Sep. 10, 2003

(65) Prior Publication Data

US 2005/0230505 A1 Oct. 20, 2005

(51) Int. Cl.
*B05B 1/00* (2006.01)
*B05B 13/03* (2006.01)

(52) U.S. Cl. ..... 118/300; 118/320; 118/319; 239/553.5

(58) Field of Classification Search ..... 118/300, 118/319, 320–321; 239/590.5, 591, 553.5; 222/594

See application file for complete search history.

(56) References Cited

U.S. PATENT DOCUMENTS

| | | | |
|---|---|---|---|
| 873,301 | A | 12/1907 | Cummings et al. |
| 2,945,739 | A | 7/1960 | Lehmicke |
| 3,834,629 | A | 9/1974 | Hellman et al. |
| 4,141,507 | A | 2/1979 | Rump |
| 4,151,955 | A | 5/1979 | Stouffer |
| 4,300,723 | A | 11/1981 | Prasthofer |
| 4,466,854 | A | 8/1984 | Hawerkamp |
| 4,494,698 | A | 1/1985 | Brown et al. |
| 4,565,515 | A | 1/1986 | Maier |
| 4,689,003 | A | 8/1987 | Schreiner et al. |
| 4,721,251 | A | 1/1988 | Kondo et al. |
| 4,741,286 | A | 5/1988 | Itoh et al. |
| 4,758,397 | A | 7/1988 | Schreiner et al. |
| 4,801,955 | A | 1/1989 | Miura et al. |
| 4,852,773 | A | 8/1989 | Standlick et al. |
| 4,982,896 | A | 1/1991 | Crow |
| 5,028,006 | A | 7/1991 | DeWinter et al. |
| 5,031,426 | A | 7/1991 | Wilson |
| 5,470,515 | A | 11/1995 | Grimm et al. |
| 5,490,554 | A | 2/1996 | Moritz |
| 5,587,117 | A | 12/1996 | Eisen et al. |
| 5,601,881 | A | 2/1997 | Grimm et al. |

(Continued)

OTHER PUBLICATIONS

"Rolls and Rollers with Baytec-Reactive Coating", FKM Walzentechnik GmbH.

(Continued)

*Primary Examiner*—Chris Fiorilla
*Assistant Examiner*—Yewebdar Tadesse
(74) *Attorney, Agent, or Firm*—Milton S. Gerstein; Much, Shelist, Freed

(57) ABSTRACT

For use in a rotational casting machine used for coating a rotating body with elastomer, such as polyurethane, there is provided a nozzle used for dispensing the liquid polyurethane onto the rotating body to be coated. The outlet of the nozzle is a narrow, elongated slit or opening. However, the interior passageway of the nozzle continually changes shape from the inlet to the outlet thereof, in order to ensure a constant cross-sectional area of the interior passageway along the length thereof, and in order to arrive at the desired narrow, elongated outlet-opening, whereby laminar flow of the liquid polyurethane is achieved with the concomitant reduced dwell-time of the liquid polyurethane therein, in order to reduce build up and clogging of the nozzle.

18 Claims, 4 Drawing Sheets

U.S. PATENT DOCUMENTS

| | | | |
|---|---|---|---|
| 5,658,386 | A | 8/1997 | Grimm et al. |
| 5,704,982 | A | 1/1998 | Oudard et al. |
| 5,895,689 | A | 4/1999 | Gajewski |
| 5,895,806 | A | 4/1999 | Gajewski |
| 5,902,540 | A | 5/1999 | Kwok |
| 6,394,369 | B1 | 5/2002 | Goenka et al. |
| 6,464,154 | B1 | 10/2002 | Heaslip et al. |

OTHER PUBLICATIONS

"Baytec Reactive Elastomers", Mobay Corp.
"Ribbon Flow Systems", Uniroyal Chemical Co., Inc.
"Baytec High Reactive Elastomer—Baytech Roll Covering, Baytec HRE-829", Mobay Corp.
"Ribbon Flow Systems—Presentation to Kastalon", May, 2001.

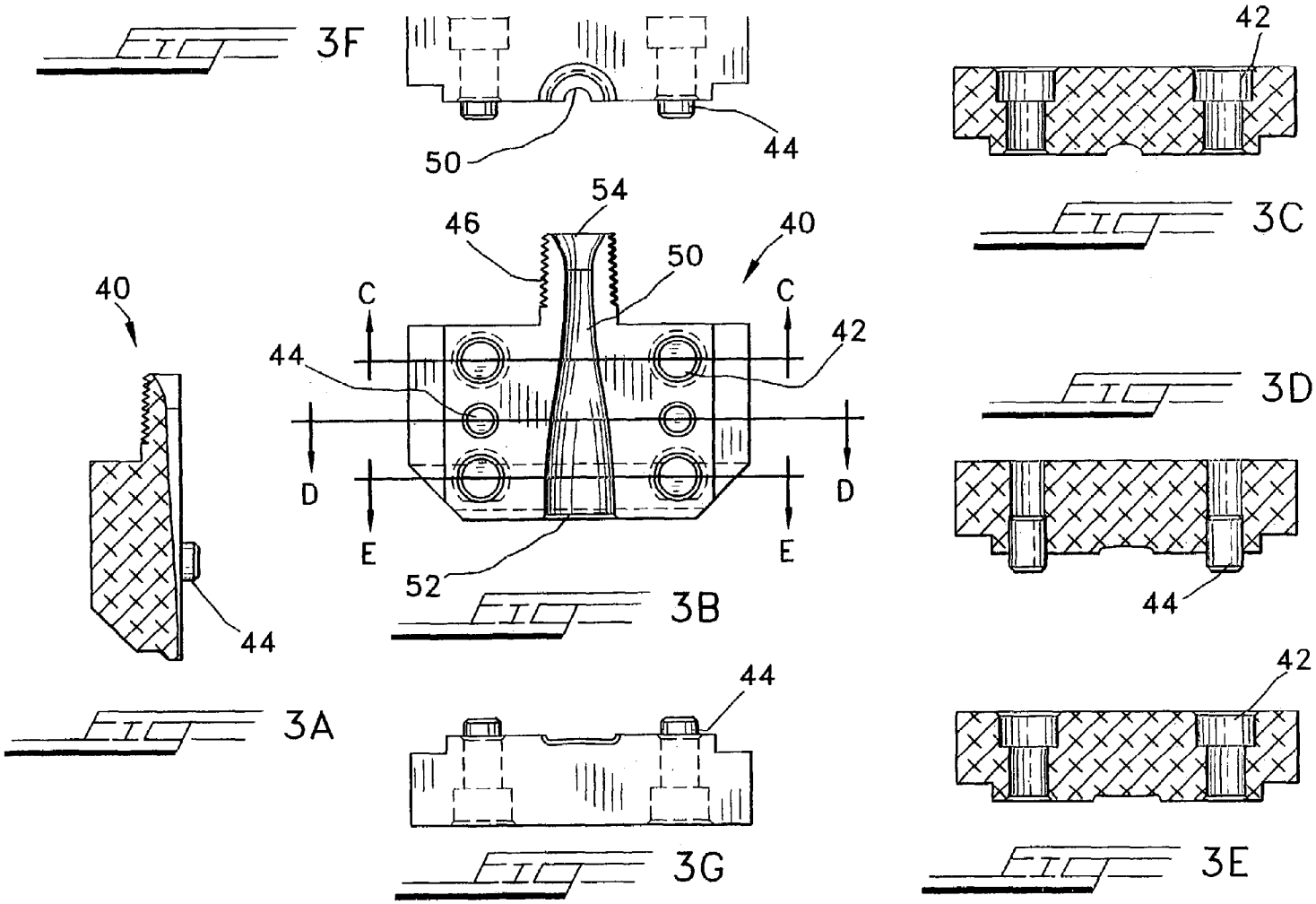
3F
3C
3D
3B
3A
3E
3G
40
42
44
46
50
52
54
C
D
E

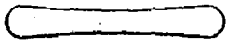
FIG 4B
54
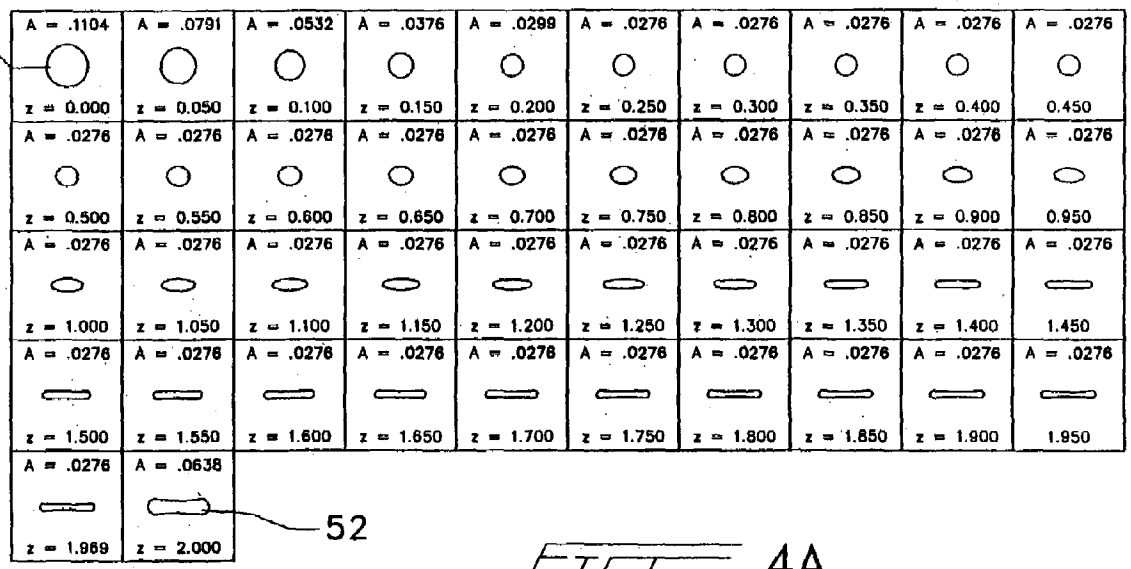
52
FIG 4A
| Z | X | Y |
|---|---|---|
| 0.000 | 0.375 | 0.375 |
| 0.050 | 0.317 | 0.317 |
| 0.100 | 0.260 | 0.260 |
| 0.150 | 0.219 | 0.219 |
| 0.200 | 0.195 | 0.195 |
| 0.250 | 0.188 | 0.188 |
| 0.300 | 0.188 | 0.187 |
| 0.350 | 0.189 | 0.186 |
| 0.400 | 0.191 | 0.185 |
| 0.450 | 0.194 | 0.182 |
| 0.500 | 0.198 | 0.179 |
| 0.550 | 0.202 | 0.176 |
| 0.600 | 0.208 | 0.172 |
| 0.650 | 0.214 | 0.168 |
| 0.700 | 0.221 | 0.163 |
| 0.750 | 0.228 | 0.157 |
| 0.800 | 0.237 | 0.152 |
| 0.850 | 0.247 | 0.146 |
| 0.900 | 0.257 | 0.139 |
| 0.950 | 0.269 | 0.133 |
| 1.000 | 0.282 | 0.126 |
| 1.050 | 0.296 | 0.119 |
| 1.100 | 0.311 | 0.112 |
| 1.150 | 0.327 | 0.104 |
| 1.200 | 0.343 | 0.098 |
| 1.250 | 0.358 | 0.092 |
| 1.300 | 0.373 | 0.086 |
| 1.350 | 0.388 | 0.081 |
| 1.400 | 0.401 | 0.076 |
| 1.450 | 0.415 | 0.072 |
| 1.500 | 0.427 | 0.068 |
| 1.550 | 0.439 | 0.064 |
| 1.600 | 0.449 | 0.061 |
| 1.650 | 0.459 | 0.058 |
| 1.700 | 0.467 | 0.056 |
| 1.750 | 0.474 | 0.054 |
| 1.800 | 0.480 | 0.052 |
| 1.850 | 0.484 | 0.051 |
| 1.900 | 0.487 | 0.050 |
| 1.950 | 0.489 | 0.050 |
| 2.000 | 0.551 | 0.113 |
FIG 4C

NOZZLE FOR USE IN ROTATIONAL CASTING APPARATUS

BACKGROUND OF THE INVENTION

The present invention is directed to a nozzle for use in a rotational casting machine used for applying one or more coats of liquid elastomer, such as polyurethane, to a rotating body, such as a pipe, cylinder, and the like, whereby an elastomer covering or coating is applied to the exterior or interior of the pipe, cylinder, or the like. The body being coated may be used in steel or paper mills, or many other industries, in order to protect the body proper during end-use, as well as for providing other desired properties. Rotational casting machines, that rotationally mount a body to be coated with polyurethane or other liquid elastomer, are disclosed, for example, in U.S. Pat. Nos. 5,601,881 and 5,658,386-Grimm, et al., and include a translational and vertically-adjustable mixing head in which is formed the polyurethane to be used for coating the body. Polyurethane chemicals such as polyols, isocyanates, catalysts, etc. are metered to the mixing head. In this process the liquid materials are dispensed onto the body being coated and react very quickly to produce the solid polyurethane that will cover or coat the body. The hardness of the elastomer-coating is controlled by the types of polyols used and their mixture-ratio, along with the corresponding adjustment of the amount of isocynate added to the mixture in the mixing head, in order to obtain hardness in both Shore A to Shore D ranges. The hardness desired for the elastomer depends upon many factors, such as end-use of the body being coated.

A considerable problem with rotational casting machines is the trade-off of forming a liquid polyurethane having a desired viscosity and reactivity in order to prevent run-off or dripping of the applied elastomer from the body being coated during the coating process, and the need to prevent the clogging of the dispensing head attached to, and forming part of, the mixing head during the coating-application process. If the viscosity is made too great or reactivity too fast, then the dispensing head tends to become clogged faster, requiring more frequent down-time in order to unclog and clean the dispensing head. Presently-used dispensing heads, such as that disclosed in above-mentioned U.S. Pat. Nos. 5,601,881 and 5,658,386, are sheet-die extruders or nozzles, which sheet-die nozzles are provided with an exit slot the width of the nozzle, in order to ensure that a wider swath of coat-application is applied. However, the problem with these prior-art dispensers is that each hypothetical section of the liquid elastomer exiting the dispensing head at the exit thereof has not, typically, had the same dwell-time in the dispensing nozzle along the width and the length thereof, whereby there is not ensued that the exothermically formed elastomer has the same properties throughout when applied to the body to be coated. Minimum dwell-time and uniform discharge from the nozzle in order to ensure equality and sameness of properties throughout is a highly desirable property in order to prevent build up, hardening or curing of the liquid elastomer therein and the concomitant clogging of the nozzle and exterior build up of whiskers or "stalactites" due to differential residence-time of the material in the nozzle. Moreover, the height and width of the slit of these sheet-die nozzles are dependent upon the viscosity and/or the reactivity of the material being dispensed, thus necessitating the replacement of one sheet-die with another one having a different slit-height and slit-width when materials of differing viscosity/reactivity are used. However, even changing sheet-dies in order to accommodate materials of different viscosity/reactivity in order to prevent frequent clogging of the sheet-die in order to obtain the desired coating thickness, has still not solved the problem of the frequent clogging and associated frequent down-times when sheet-die nozzles are used. This may be attributed to the fact that the flow of the material in the dispensing nozzle is not laminar, causing variation in dwell-time of the liquid in the nozzle, such that the dwell-time for some segments of the liquid are greater than a required minimum, leading to at least partial solidification of those segments in the interior of the nozzle. Over time, a build-up of solidified material develops, causing clogging at or near the exit, as well as interiorly thereof which forms the build up of solidified whiskers or "stalactites" of reacted material that interferes with the material deposition on the body.

FIGS. 1A and 1B show a conventional sheet-die nozzle 10 used on a typical and conventional rotational casting machine discussed above. The sheet-die nozzle 10 includes a mixing-head attaching section 12 for securing the nozzle to a mixing head in which is contained the liquid elastomer, such as polyurethane, to be dispensed. The interior of the nozzle 10 contains a circular-cross-sectioned passageway 14 through which the liquid elastomer flows from the mixing head to the exit of the nozzle. As can be seen in FIG. 1A, the interior passageway consists of a first main line 16 which ends in an upper frustoconical-shaped entrance that immediately fluidly communicates with the exit or outlet of the mixing head. The main line 16 branches off into two branch-lines 18, 20, each of which terminates into a sheet-die slit opening 22, best seen in FIG. 1B, which slit-opening 22 extends substantially the full width of the nozzle-housing 10'. The exit of the sheet-die nozzle is a relatively elongated and narrow slit or opening, so that a wide swath of the liquid elastomer may be applied to the body to be coated, and to ensure that the drying time of the liquid is sufficiently short enough so as to prevent dripping of the applied liquid off of the element to which it has been applied. If the exiting stream of liquid material were too thick, or tall, the interior portion of the reacting liquid while still in a fluid state would not have built enough viscosity to support the column height of the stream and would run or drip off the body to which it was applied. If the reactivity were adjusted to build sufficient viscosity quickly enough to support the stream column height, the stream would not be liquid enough to flow onto the precedingly-applied material and an uneven coating would result. In a typical sheet-die nozzle 10, called a ribbon-flow nozzle manufactured by Bayer Manufacturing Co., the radius of the main passageway 16 is approximately 0.079 in., while the radius of each of the branch lines 18, 20 is approximately 0.059 in., while the slit-opening 22 has a height of approximately 0.020 in. It may, therefore, be seen that liquid material flow through the interior passageway 14 of the prior-art sheet-die nozzle 10 has considerable turbulent and boundary-layer flow characteristics, causing increased dwell-time of a hypothetical section of the flowing liquid material, which, in turn, causes increased clogging of the passageway 14 and slit-opening 22, since the greater the time any section of liquid material is present in the passageway 14, the greater the likelihood it will start to cure. This has, in fact, been one of the serious problems of the prior-art nozzle for rotational casting machines; that is, in a relatively short period of time, the nozzle becomes clogged and unusable, requiring the disassembly and cleaning thereof, which also causes considerable down-time to the rotational casting machine. Moreover, since the slit-opening 22 is fed by two branches feeding into the ends of the slit-opening, the liquid-material application onto to the body to be coated is ofttimes inconsistent and uneven, and is also limiting in the range that the distance the nozzle may be relative to the body to be coated.

FIGS. 2A and 2B show another prior-art type of nozzle 30 used in rotational casting machines. The nozzle 30 differs from the nozzle 10 of FIGS. 1A and 2B in that, in addition to the first main line 32, and two branch passageways 34, there are provided four sub-branches 36 with two extending from each branch 34, and eight capillaries 38, two from each sub-branch 36. Each capillary 38 ends in a circular outlet opening 38' that together constitute the dispensing outlet for the nozzle 30. Thus, rather than an elongated slit-opening as in the nozzle 10 of FIGS. 1A and 1B, a series of equally-spaced openings, such as eight, are provided, through which the flowing liquid material is dispensed, as can be seen in FIG. 2B. In a typical, prior-art nozzle 30 manufactured by Uniroyal ChemicalDivision of Crompton Corp., the diameter of the circular-cross-sectioned main line 32 and two branches 34 is approximately 0.078 in. The diameter of each sub-branch 36 is approximately 0.063 in, while the diameter of each capillary 38 is approximately 0.047 in. Each capillary terminates into an exit hole of approximately 0.031 inch in diameter. The nozzle 30, by using equally-spaced apart dispensing holes 38', has helped to overcome the drawback of uneven and inconsistent dispensing flow and application of the slit-opening 22 of the prior-art nozzle 10 of FIGS. 1A and 1B. However, the prior-art nozzle 30 has not addressed nor overcome the problem of consistent and frequent clogging of interior passageways described above with regard to the nozzle 10 of FIGS. 1A and 1B. In fact, owing to the narrowing of the outlet opening or holes 38' of the nozzle 30, in some circumstances the problem with clogging and flow-impairment has been aggravated by the prior-art nozzle 30 of FIGS. 2A and 2B.

In conjunction with the need for a relatively thin exit stream of liquid material from the nozzle to ensure adequate support for the mass of the applied liquid material to the body to be coated, the rotational speed of the body being coated, and the relative translational speed between the nozzle and rotating body, must be coordinated with the speed of the liquid material exiting from the nozzle. If the rotational speed of the rotating body were to be too great in comparison to the exit speed of the liquid material from the nozzle-exit, then the applied coat may be thinner than required, and require additional coating layers to be applied to the rotating body, reducing the efficiency of the process, and also would cause air to become entrapped in the applied liquid, causing air blisters to form, since there would not be enough time for the applied stream to push out the air between the applied stream and the surface of the rotating body. On the other hand, if the rotational speed were to slow, then productivity and efficiency of the process would be adversely affected, would also increase the likelihood of premature curing, causing the eventual clogging of the nozzle, and uneven application of the coating to the rotating body. Similarly, if the relative translational motion between the exit-nozzle and the rotating body were too great, then air blisters would form, and, in addition, an applied coating of liquid material thinner than is required and optimal would be formed. Similarly, if the relative translational motion between the exit-nozzle and the rotating body were too slow, the efficiency and productivity of the process would be adversely affected, and would also cause an applied coating that would be too thick, thus causing dripping of the applied liquid from the body being coated, as well as potentially uneven thickness of the applied coat.

The need and requirement for optimal correspondence between exit speed of the liquid from the nozzle, the thickness of the exiting stream of liquid, the rotational speed of the rotating body being coated relative to this exit speed of the liquid from the nozzle, and the relative translational speed between the nozzle and the rotating body being coated has imposed significant constraints as to linear distance the exit of the nozzle of the rotating casting machine may be from the surface of the rotating body being coated. Presently-used rotational casting machines provide an outer limit of only approximately 5 mm. of the nozzle-exit from the surface of the rotating body being coated. A distance greater than 5 mm. has been found to cause excessive clogging of the nozzle, with a concomitant increase of downtime of the machine for unclogging the nozzle. This excessive clogging ensues from the fact that as the nozzle-exit distance from the surface to be coated is increased, the exit-speed of the liquid must be increased in order to compensate therefor. The increase in speed of the liquid through the nozzle increases turbulent flow in the nozzle, thus increasing the dwell-time of the liquid in the nozzle, and the increased curing thereof in the nozzle, with the ensuing clogging of the nozzle, as discussed hereinabove. Besides the increased clogging of the nozzle, air blisters form in the applied coating of liquid, for the reasons described hereinabove due to the increased exit speed of the liquid from the nozzle-exit.

Another considerable problem with the sheet-die nozzle of FIG. 1 is that the size of the rotating body that may be coated with the liquid exiting therefrom is limited. Cylindrical bodies having a diameter less than approximately five inches have not been able to effectively coated with liquid. This is because of the requirement described above for correlation between the speed of the rotational body to be coated, the exit-speed of the liquid from the nozzle-exit, and the turbulent flow of the liquid in the nozzle proper and the increased dwell-time of the liquid in the nozzle associated therewith.

SUMMARY OF THE INVENTION

It is the primary objective of the present invention to provide an improved nozzle for a rotational casting machine, which nozzle overcomes the above-mentioned drawbacks and limitations of prior-art nozzles for rotational casting machines.

It also the primary objective of the present invention to provide such an improved nozzle for a rotational casting machine, which nozzle increases the efficiency and productivity of the rotational casting machine, reduces downtime thereof, more effectively coats cylindrical bodies, is able to effectively coat cylindrical bodies of smaller diameter than hitherto possible, and is better able to prevent air-blistering of the coating.

Toward these and other ends, the liquid-dispensing nozzle for rotational casting machines comprises a liquid-flow interior passageway that changes shape along the longitudinal axis thereof from inlet to outlet, but which maintains a constant cross-sectional area throughout the changing cross-sectional shapes, whereby laminar flow occurs throughout the interior flow-passageway of the nozzle, to thus minimize the dwell-time of the liquid in the nozzle, and, thereby, considerably reduce and minimize clogging of the nozzle.

In accordance with the nozzle of the present invention, the exit or outlet thereof is formed as a narrow, elongated slit or opening, in the manner somewhat similar to the slit or opening of the prior-art sheet-die nozzle, in order to maintain the advantages thereof. However, the interior passageway of the nozzle continually changes shape from the inlet to the outlet thereof, in order to ensure a constant cross-sectional area of the interior passageway along the length thereof, and in order to arrive at the desired narrow, elongated outlet, ensuring consistent pressure of the liquid across the entire area, whereby laminar flow of the liquid is achieved with the concomitant reduced dwell-time of the liquid polyurethane therein, in order to reduce in-nozzle reaction and subsequent clogging of the nozzle.

BRIEF DESCRIPTION OF THE DRAWINGS

Reference is had to the accompanying drawings, wherein:

FIG. 3A is a side elevational view of the each half of the nozzle for a rotational casting machine of the present invention;

FIG. 3B is a top view thereof;

FIG. 3C is a cross-sectional view taken along line C—C of FIG. 3B;

FIG. 3D is a cross-sectional view taken along line D—D FIG. 3B;

FIG. 3E is a cross-sectional view taken along line E—E of FIG. 3B;

FIG. 3F is a first end view of the half of the nozzle of FIG. 3A;

FIG. 3G is a second end view thereof;

FIG. 4A is a chart showing the various transverse, cross-sectional shapes of the interior flow-passageway of the nozzle of the present invention each cross section having the same cross-sectional area along the length nozzle of the present invention;

FIG. 4B is an end view of the nozzle-outlet of the nozzle of the present invention; and FIG. 4C is a chart showing the x-y-z coordinate-dimensions of the various cross sections of FIG. 4A.

DETAILED DESCRIPTION OF THE INVENTION

Figure 1A:
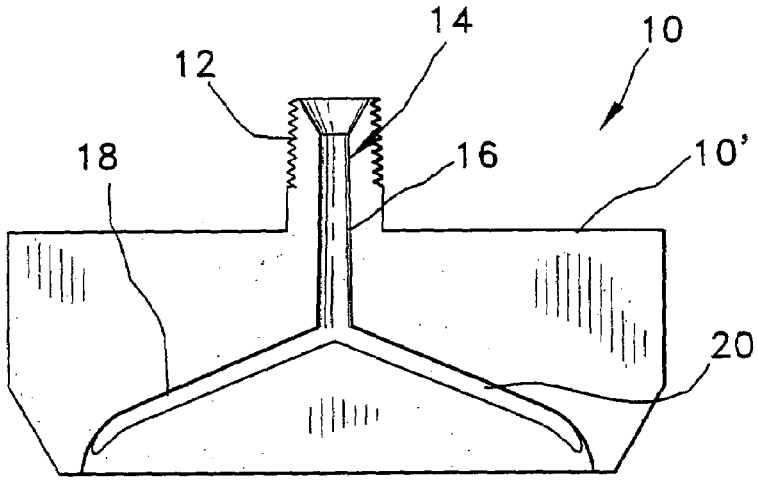
FIG. 1A is a top sectional view of a prior-art sheet-die nozzle used in a rotational casting machine.
Figure 1B:
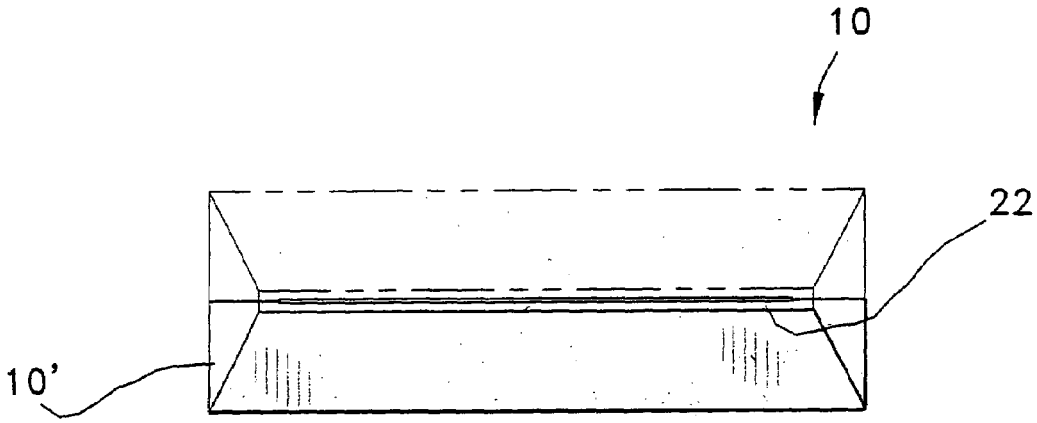
FIG. 1B is a front view thereof.

Referring now to the drawings in greater detail, and to FIGS. 3A–G for now, there is shown a half-section 40 of the nozzle of the present invention, it being understood that the other half-section of the nozzle of the invention is substantially identical. Each half-section 40 has a plurality of holes 42 through which pass bolts for securing the two-halves together. Alignment pins 44 in the half-section 40 cooperate with openings in the other-half section for initially aligning the half-sections together. Each half-section also has an upper threaded portion 46, whereby after the two half-sections have been attached, provide an attachment section for securing the nozzle to the mixing head of a rotational casting machine in the conventional manner, in which mixing head are mixed the prepolymers for forming the polyurethane used to coat a rotating body held by the rotational casting machine.

In accordance with the nozzle of the present invention, the nozzle of the invention defines one main, unbranched interior passageway 50 through which the liquid from the mixing head is dispensed onto a rotating body held by the rotational casting machine. The interior passageway of the nozzle of the invention periodically changes cross-sectional shape, as further described hereinbelow. The interior flow passageway is so configured as to ensure that the flow of the liquid is entirely laminar therethrough. This laminar flow ensures the shortest possible dwell-time of any hypothetical element of liquid therein. Since the liquid polyurethane has been formed by exothermic reaction in the mixing head via the metered in chemical reactants, and since the liquid has a short, reaction time once exiting the mixing head, any delay of passage through the nozzle would cause the liquid to solidify within the nozzle passageway, to cause the clogging thereof, as has been the problem with prior-art, rotational casting machine dispensing nozzles, as described hereinabove. By ensuring laminar flow throughout the length of the passageway of the nozzle of the invention, dwell time is reduced, and the concomitant reaction of the liquid and clogging of the passageway thereby is greatly reduced as compared to prior art rotational casting machine dispensing nozzles.

Referring now to FIGS. 4A–4C, since the nozzle of the present invention has special function for use in rotational casting machines, the exit opening 52 of the passageway 50 of the nozzle is one that dispenses the liquid material over a wide swath, for the reasons given hereinabove; that is, the exit opening 52 is made relatively elongated in width, in the "x" coordinate direction, yet narrow in height, in the "y" coordinate direction, as depicted in FIG. 4B. Referring to FIG. 4A, there is shown a series of transverse cross-sectional views of the nozzle of the invention along the longitudinal axis of the passageway 50, it being noted that value "A" indicated refers to the cross-sectional area of the respective cross section. The distance along the longitudinal axis from the inlet 54 (FIG. 3B) is defined as the "z" dimension in FIGS. 4A and 4C. FIG. 4C shows the corresponding x, y and z dimensions for the transverse cross sections of FIG. 4A, it being understood that the cross section of the inlet 54 of the passageway has a zero "z" value, while the outlet 52 of the passageway has a "z" value of two inches in the preferred embodiment where the length of the entire passageway is two inches, it also being understood that the length of the passageway may vary depending upon type of liquid coating being dispensed, the sizes of the outlet 52 and inlet 54, and other variables that would be clear to one of ordinary skill in the art.

Referring again to FIG. 4A, the transverse cross sections from z=0 until z=0.250 in. is a transitional inlet section of the interior passageway of the nozzle 50, with each inlet section being of circular cross section in correspondence with the circular exit-opening of a conventional mixing head associated with a conventional rotational casting machine. At z=0, which is the inlet 54, the diameter thereof is the same as the circular exit-opening of a conventional mixing head. For the next four transverse cross sections from z=0.05 until z=0.25, the diameter of each circular cross section diminishes, diminishing the cross-sectional area of the transverse cross section from an inlet-cross-sectional area of 0.1104 to a cross-sectional area of 0.0276 at z=0.250. This transitional inlet section of the interior passageway of the nozzle 10 defines a venturi-flow inlet-section, whereby laminar flow is achieved therethrough. The cross-sectional area "A" of 0.0276 of each subsequent transverse cross section until z=1.969 remains constant until reaching the outlet 52 at z=2.000. Maintaining this equality of cross-sectional area from z=0.250 until z=1.969 ensures laminar flow of the liquid polyurethane therethrough. As can be seen in FIG. 4A, in order to maintain the same cross-sectional area from the inlet-section until reaching the desired elongated outlet 52, the cross-sectional shape of the passageway continually changes. From z=0.300 until 0.500, the cross section is circular. From z=0.650, the cross section starts a transition into an ellipse-like shape. This ellipse-like cross-sectional shape continually changes, such that the major and minor axes of the ellipse-like cross-sectional shape changes until approximately z=1.250. After z=1.250, the cross-sectional shape transforms into a more elongated slot-like opening until z=1.600. At z=1.650, the cross-sectional shape starts a transition into an elongated, flared-end shape, or an oval-of-Cassini shape, where the end-portions of the cross-section are slightly flared as compared with the center-section. Finally, at the outlet or exit 52, the cross-sectional shape is the same as that of the cross-sectional areas from z=1.650 to z=1.969, but the cross-sectional area thereof is considerably greater at 0.0638, in accordance with the need for applying the coating over a relatively larger area (greater x-coordinate dimension and y-coordinate dimension), so that a thin, ribbon-like coating is applied to the rotating body to promote fast drying-times, in order to prevent dripping of the liquid polyurethane from the body being coated therewith.

It is to be understood that the length of the interior passageway 50 of the nozzle 40 may vary depending on a number of factors, such as the type of pre-polymers used, the specific liquid elastomer applied, the size and type of body to be coated, and the like. The length of two inches for the passageway 50 shown in the drawings and described above has been given by way of example only, and is not meant nor intended to be limiting. Moreover, the actual various cross-sectional shapes in the interior passageway 50 shown in the drawings and discussed hereinabove, where the cross-sectional area of each such shape is the same as another, are shown by way of example, and is not intended to exclude other shapes and cross-sectional areas, as long as the cross-sectional area of each such shape is the same as another such shape, in order to ensure equality of dwell-time of each hypothetical section of flowing liquid polyurethane therein, where the outlet-opening 52 is of such size and shape so as to ensure a spray or application of liquid elastomer coating, such as polyurethane, to a body that allows the drying of the liquid polyurethane on the body being coated before dripping occurs, which also ensures an even thickness to the applied coating, and which also prevents air-blistering. Owing to this constancy of cross-sectional area along the length of the interior passageway 50 after the venturi-flow inlet-section, the flow through the entire interior passageway is substantially laminar, having a Reynolds number of less than 2100.

Figure 2A:
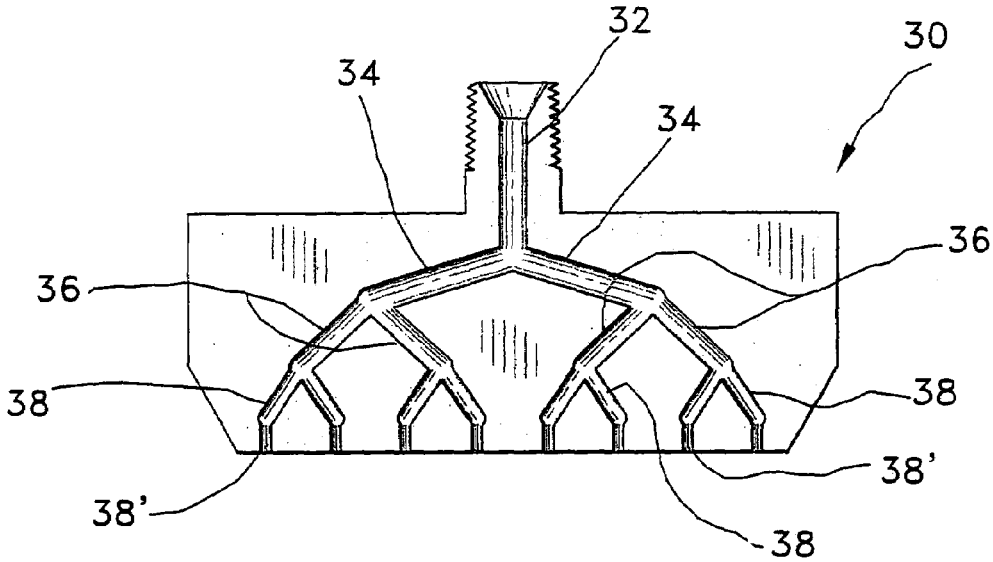
FIG. 2A is a top sectional view of another prior-art nozzle used in a rotational casting machine.
Figure 2B:
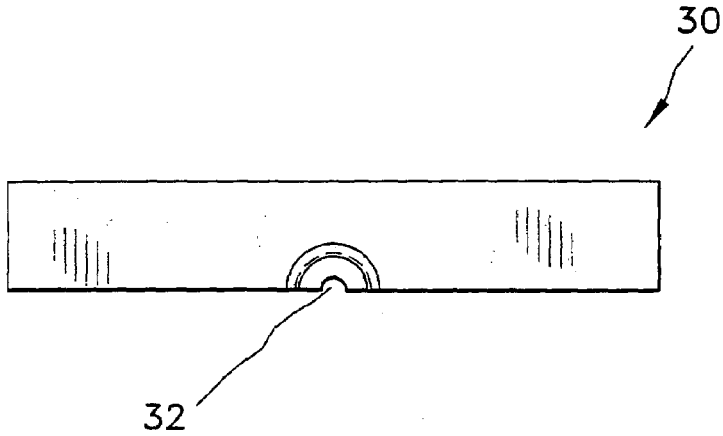
FIG. 2B is a front view thereof.

With the nozzle 40 of the present invention, it is possible to coat bodies of smaller diameter as compared with the prior-art nozzles of FIGS. 1A and 2A. Whereas prior-art, rotational-casting-machine nozzles have been able to effectively coat only a cylindrical body down to a minimum diameter of about five inches, the nozzle 40 has been able to effectively coat a cylindrical body of about two inches in diameter. In addition, the distance the outlet of the nozzle 40 of the invention from the surface of the body to be coated may be increased to as much as 25 mm., as compared to 10 mm. for prior-art devices, without causing air-bubbling. This means that the liquid-elastomer deposition rate onto the body to the coated may be increased from between 50%–150% as compared with the prior-art nozzles of FIGS. 1A and 2A.

It is, also, noted that the nozzle of the invention may be provided with one or more additional interior passageways identical to interior passageway 50 if increased liquid-elastomer deposition rates are desired, as, for example, when coating extra large and/or long bodies. In this modification, the plurality of interior passageways 50 would preferably be equally-spaced apart along the width of the main housing of the nozzle.

For the example given above, with the cross-sectional shapes and dimensions shown in the FIGS. 4A–4C, the following algorithm accurately describes the interior passage 50.

"Algorithm"

The inlet and outlet cross-sections are both considered to be in x-y planes, separated by a distance dz in the z-axis, where each point on the inlet is matched up with a point on the outlet. Create a new cross-section profile using the following equations to transform each point of the inlet/outlet profile.

$$X_{new}=(X_{inlet}+X_{outlet})/2$$

$$Y_{new}=(Y_{inlet}+Y_{outlet})/2$$

Determine the cross-sectional area of the new profile. Then, to calculate all of the new cross-sections, use the following algorithm:

$$n=8(A_{new}/A_{inlet}-1)$$

For each z in the range $\{Z_{inlet} \ldots Z_{outlet}\}$ $$t=(z-Z_{inlet})/(Z_{outlet}-Z_{inlet})$$

If t is in the range {0 . . . 0.50}, then $$p=2\,t^2$$

$$s=(-2n1)^4+nt^2+1)^{-0.5}$$

If t is in the range {0.50 . . . 1}, then $$p=1-2(1-t)^2$$

$$s=(-2n(t-1)^4+n(t-1)2+1)^{0.5}$$

For each (x, y) point in the inlet/outlet profiles $$x=s[(1-p)^x inlet+p^x outlet]$$

$$y=s[(1-p)yinlet+p^y outlet]$$

Next (x, y) point

Next z

Software code listing for performing the above-detailed algorithm is as follows:

```
Sub CreateConstantAreaCrossSectionsFromPolylines( )
'This sub will create cross-sections between two lightweight polylines
'(equal number of segments required) at different z-elevations. It uses
'a 2nd order polynomial cam equation to shift from one polyline to the other,
```

-continued

```
'along with a scaling factor in order to maintain a constant area cross-section.
On Error Resume Next
Dim objEnt1 As AcadEntity, objEnt2 As AcadEntity, objEnt3 As AcadEntity
Dim varPick As Variant
Dim varWCS As Variant
Dim dz As Double
dz = 1.46875 'z distance of line segments
With ThisDrawing.Utility
        .GetEntity objEnt1, varPick, vbCr & "Pick the first polyline:"
        'Check entity
If (objEnt1.ObjectName <> "AcDbPolyline") Or (objEnt1 Is Nothing) Then
            .Prompt "You did not pick a polyline."
Exit Sub
End If
.GetEntity objEnt2, varPick, vbCr & "Pick the second polyline:"
'Check entity
If (objEnt2.ObjectName <> "AcDbPolyline") Or (objEnt2 Is Nothing) Then
.Prompt "You did not pick a polyline."
Exit Sub
End If
'Check for equal number of segs
If UBound(objEnt1.Coordinates) <> UBound(objEnt2.Coordinates) Then
    .Prompt "Polylines do not have the same number of segments. The first had" &
Str$((UBound(objEnt1.Coordinates) + 1)/2) & "and the second had" &
Str$((UBound(objEnt2.Coordinates) + 1)/2) & "."
        Exit Sub
    End If
.GetEntity objEnt3, varPick, vbCr & "Pick the axis line:"
'Check entity
If (objEnt3.ObjectName <> "AcDbLine") Or (objEnt3 Is Nothing) Then
.Prompt "You did not pick a line."
        Exit Sub
    End If
        Dim plEnt1 As AcadLWPolyline, plEnt2 As AcadLWPolyline, plEnt3 As
AcadLWPolyline
        Dim lAxis As AcadLine
        Dim dblPts( ) As Double
        Set plEnt1 = objEnt1
        Set plEnt2 = objEnt2
        Set lAxis = objEnt3
        'Make sure line is going in correct direction; if it's not, swap the endpts
        If DistXYZ(plEnt1.Coordinates(0), lAxis.StartPoint) >
DistXYZ(plEnt2.Coordinates(0), lAxis.StartPoint) Then
        Dim Tmp As Variant
        Tmp = lAxis.StartPoint
c:\acad\vba\nozzle.dvb
        lAxis.StartPoint = lAxis.EndPoint
        lAxis.EndPoint = Tmp
End If
    'If plEnt2.Area <> plEnt1.Area Then
    'ThisDrawing.Utility.GetPoint varPick, "Cross-sectional areas are not equal.
Select the scaling center:"
    'plEnt2.ScaleEntity varPick, Sqr(plEnt1.Area/plEnt2.Area)
    'End If
z1 = plEnt1.Elevation
z2 = plEnt2.Elevation
ReDim dblPts(UBound(plEnt1.Coordinates))
Dim cir As AcadCircle, ptCtr(2) As Double
Dim n As Double, t As Double, s As Double, z As Double
'Create 50% plEnt1, 50% plEnt2 hybrid to get area
pidx = 0
For idx = 0 To UBound(plEnt1.Coordinates) Step 2
        x1 = plEnt1.Coordinates(idx)
        y1 = plEnt1.Coordinates(idx + 1)
        x2 = plEnt2.Coordinates(idx)
        y2 = plEnt2.Coordinates(idx + 1)
        dblPts(pidx) = (x1 + x2)/2#
        dblPts(pidx + 1) = (y1 + y2)/2#
        pidx = pidx + 2
Next idx
Set plEnt3 = ThisDrawing.ModelSpace.AddLightWeightPolyline(dblPts( ))
plEnt3.Update
n = 8 * (plEnt3.Area/plEnt1.Area − 1)
plEnt3.Delete
ReDim dblPts(1.5 * (1 + UBound(plEnt1.Coordinates)) − 1)
If z2 < z1 Then dz = −dz
For z = z1 To z2 Step dz 't = 0 To 1 Step dz/Abs(z2 − z1)
        pidx = 0
        = (z − z1)/(z2 − z1)
```

-continued

```
        If t <= 0.5 Then
        p = 2 * t^2
        s = (-2 * n * t^4 + n * t^2 + 1)^-0.5
Else
        p = 1 - 2 * (1 - t)^2
        s = (-2 * n * (1 - t)^4 + n * (1 - t)^2 + 1)^-0.5
End If
For idx = 0 To UBound(plEnt1.Coordinates) Step 2
        x1 = plEnt1.Coordinates(idx)
        y1 = plEnt1.Coordinates(idx + 1)
        x2 = plEnt2.Coordinates(idx)
        y2 = plEnt2.Coordinates(idx + 1)
        dblPts(pidx) = s * (p * x2 + (1 - p) * x1) '2nd degree polynomial
        dblPts(pidx + 1) = s * (p * y2 + (1 - p) * y1) + '2nd degree polynomial
        dblPts(pidx + 2) = t * z2 + (1 - t) * z1 '1st degree polynomial
        pidx = pidx + 3
    Next idx
    'dblPts(pidx) = x2
    'dblPts(pidx + 1) = y2
        'dblPts(pidx + 2) = z2
        Draw3DPolyline dblPts
            SetPt ptCtr, 0, 0, z
        DrawCircle ptCtr, 0.005
        cir.Update
    Next z
 End With
End Sub
```

Copyright Kastalon, Inc. 2003

While a specific embodiment of the invention has been shown and described, it is to be understood that numerous changes and modifications may be made therein without departing from the scope and spirit of the invention as set forth in the appended claims. The dispensing nozzle described hereinabove may have applications and uses in machines other than rotational casting apparatuses, and may also have application and use in the dispensing of other fluids, whether liquid or gas, and not just elastomers.

What is claimed is:

1. A nozzle for dispensing a liquid, such as an elastomer for use with a rotational casting apparatus used to coat a body, comprising:

an interior flow passageway through which liquid flows;

said interior flow passageway defining a straight longitudinal axis along the length thereof, and having an inlet section, an intermediate section, and an outlet opening;

said intermediate section comprising a plurality of different portions, each said portion having a cross-sectional shape along said longitudinal axis different from a cross sectional shape of another of said plurality of different portions; each said cross-sectional shape being defined in a plane transverse to said longitudinal axis;

each said cross-sectional shape of each of said plurality of different portions defining a cross-sectional area substantially equal to the cross-sectional area of another said cross-sectional shape of said plurality of different cross-sectional shapes;

said outlet opening having a substantially elongated-like shape and having a cross-sectional area greater than said cross-sectional area of each said cross-sectional shape of said plurality of different cross-sectional shapes, whereby substantial laminar flow through said intermediate section and substantial equality of dwell-time of each hypothetical section of flowing liquid in said intermediate section occurs.

2. The nozzle according to claim 1, wherein said inlet section of said interior passageway comprises laminar-flow tubular section for ensuring laminar flow therein.

3. The nozzle according to claim 2, wherein said laminar-flow tnbular section for ensuring laminar flow comprises a venturi-flow tubular portion, said venturi-flow tubular portion having an end-cross-section having a cross-sectional area substantially equal to said cross-sectional area of each of said plurality of different cross-sectional shapes.

4. The nozzle according to claim 1, wherein said plurality of different protions comprises a first series of substantially circular cross sections and second series of substantially ellipse-like cross sections.

5. The nozzle according to claim 4, wherein said plurality of different portions further comprises a third series of substantially elongated slot-like cross sections.

6. The nozzle according to claim 5, wherein at least some of said third series of substantially elongated slot-like cross sections are an oval-of-Cassini-like shape.

7. The nozzle according to claim 6, wherein said outlet opening is an oval-of-Cassini-like shape.

8. The nozzle according to claim 1, wherein said outlet opening is an oval-of-Cassini-like shape.

9. The nozzle according to claim 1, wherein said outlet opening comprises a cross-sectional area at least twice as great as said cross-sectional area of each said cross-sectional shape of said plurality of different cross-sectional shapes.

10. The nozzle according to claim 1, wherein said plurality of different portions shapes comprises a first series of substantially circular cross-sectional shapes, and a second series of substantially elongated cross-sectional shapes.

11. The nozzle according to claim 10, wherein at least some of said second series of substantially elongated cross-sectional shapes are an oval-of-Cassini-like shape.

12. The nozzle according to claim 11, wherein said outlet opening is an oval-of-Cassini-like shape.

13. The nozzle according to claim 12, wherein said outlet opening comprises a cross-sectional area at least twice as great as said cross-sectional area of said second series of cross-sectional shapes.

14. The nozzle according to claim 10, wherein each said cross section of said second series of substantially elongated cross-sectional shapes comprises a horizontal x-coordinate dimension and a vertical y-coordinate direction; each said cross section of said third series of elongated cross-section shapes having a x-y product different from that of any other respective said cross section of said third series.

15. The nozzle according to claim 1, wherein said inlet section of said interior passageway comprises a laminar-flow tubular section for ensuring laminar flow therein; said laminar-flow tubular section comprising a venturi-flow tubular portion, said venturi-flow tubular portion having a circular end-cross-section having a cross-sectional area substantially equal to said cross-sectional area of each of said plurality of different cross-sectional shapes.

16. A dispensing nozzle for dispensing fluid comprising:

an unbranched interior flow passageway through which the liquid flows;

said interior flow passageway defining a straight longitudinal axis along the length thereof and having an inlet section, an intermediate section and an outlet;

said intermediate section comprising a plurality of different cross-sectional shapes along said longitudinal axis; each said cross-sectional shape being defined in a plane transverse to said longitudinal axis;

each said cross-sectional shape defining a cross-sectional area substantially equal to the cross-sectional area of another said cross-sectional shape.

17. The dispensing nozzle according to claim 16, wherein said outlet has a shape similar to the shape of the last cross-sectional shape of said intermediate section adjacent thereto, whereby substantial laminar flow through said intermediate section and substantial equality of dwell-time of each hypothetical section of flowing liquid in said intermediate section occurs; said plurality of different cross sections comprising a first series of substantially circular cross-sectional shapes, a second series of substantially ellipse-like cross-sectional shapes, and a third series of substantially elongated cross-sectional shapes.

18. A dispensing nozzle comprising:

an interior flow passageway through which fluid flows;

said interior flow passageway defining a longitudinal axis along the length thereof, and having an inlet section, an intermediate section, and an outlet opening;

said intermediate section comprising a plurality of different cross-sectional shapes along said longitudinal axis; each said cross-sectional shape being defined in a plane transverse to said longitudinal axis; and each said cross-sectional shape defining a cross-sectional area substantially equal to the cross-sectional area of every other said cross-sectional shape of said plurality of different cross-sectional shapes.

* * * * *